United States Patent [19]

Mussari

[11] Patent Number: 4,679,757

[45] Date of Patent: Jul. 14, 1987

[54] ADJUSTABLE BOOKHOLDER

[76] Inventor: Fred P. Mussari, 14456 Portland Ave. S., Burnsville, Minn. 55337

[21] Appl. No.: 864,296

[22] Filed: May 16, 1986

[51] Int. Cl.[4] ..... A47B 97/08

[52] U.S. Cl. ..... 248/463; 248/165; 248/205.2

[58] Field of Search ..... 248/455, 459, 463, 465, 248/460, 165, 205.2, 461; 281/33, 45, 49

[56] References Cited

U.S. PATENT DOCUMENTS

| | | | |
|---|---|---|---|
| 639,370 | 12/1899 | Gary . | |
| 1,112,041 | 9/1914 | Treadway . | |
| 1,278,619 | 9/1918 | Fant . | |
| 1,728,431 | 9/1929 | Mevi | 281/33 |
| 1,840,620 | 1/1932 | Dennis . | |
| 1,957,039 | 5/1934 | Buenger et al. | 281/33 |
| 2,451,694 | 10/1948 | Schade . | |
| 2,474,532 | 6/1949 | Kitchen | 248/461 X |
| 2,490,356 | 12/1949 | Hummel . | |
| 3,417,954 | 12/1968 | Croninger . | |
| 4,239,411 | 12/1980 | Moliard . | |
| 4,315,642 | 2/1982 | Errichiello . | |
| 4,355,821 | 10/1982 | Crawford | 281/33 |
| 4,436,442 | 3/1984 | Miskin . | |
| 4,440,373 | 4/1984 | Beitler et al. | 248/465 X |
| 4,466,638 | 8/1984 | Miskin . | |
| 4,607,817 | 8/1986 | Aquino | 248/165 X |

FOREIGN PATENT DOCUMENTS

| | | | |
|---|---|---|---|
| 2439679 | 6/1980 | France | 281/33 |
| 227362 | 8/1943 | Switzerland | 281/33 |

*Primary Examiner*—Ramon S. Britts
*Assistant Examiner*—Karen J. Chotkowski
*Attorney, Agent, or Firm*—Merchant, Gould, Smith, Edell, Welter & Schmidt

[57] ABSTRACT

An adjustable bookstand or bookholder (10) includes a retractable easel (32) mounted on the spine (16) for movement between extended and retracted positions. The easel (32) includes brace members (34 and 36) which are easily and conveniently adjusted to change the supported angle of inclination as desired. Releasable connectors (40, 42, and 44) are preferably provided for securing the easel (32) in retracted position within the bookholder (10).

3 Claims, 4 Drawing Figures

FIG. 1
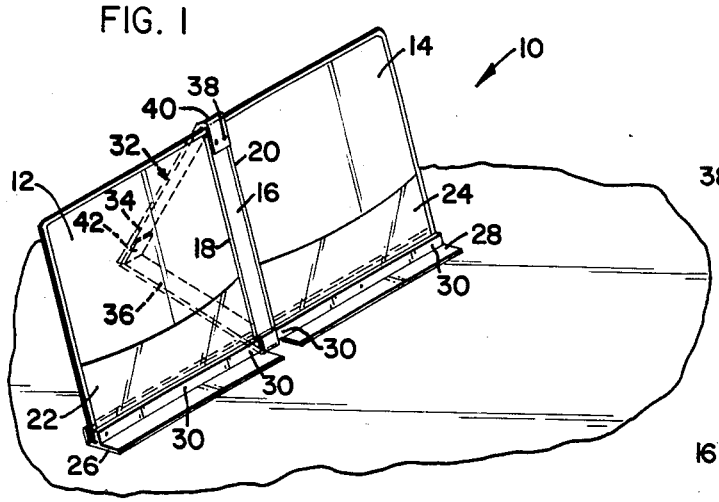
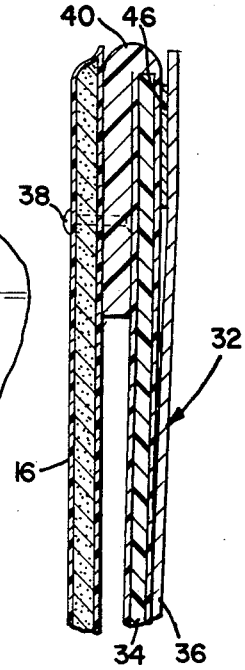
FIG. 2
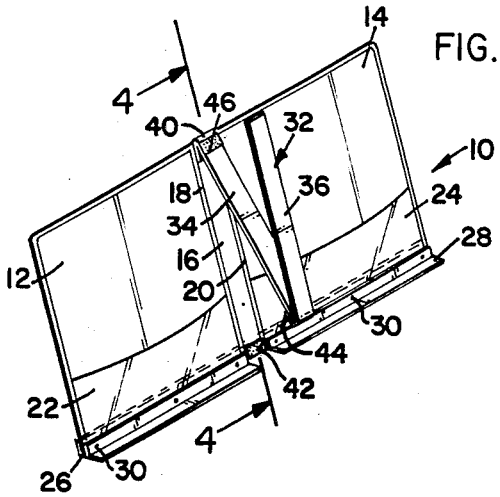
FIG. 3
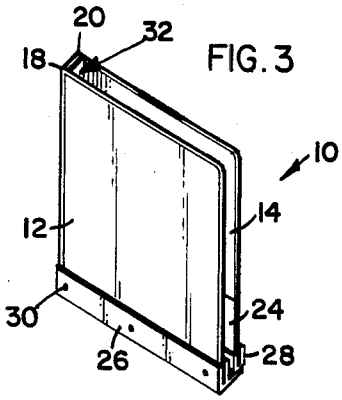
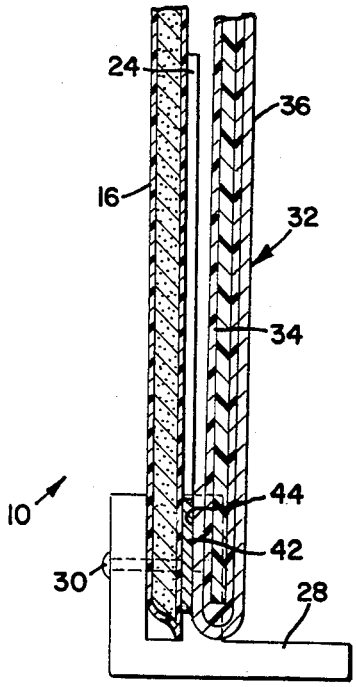
FIG. 4

ADJUSTABLE BOOKHOLDER

TECHNICAL FIELD

The present invention relates generally to a bookstand or bookholder. More particularly, the present invention relates to an adjustable bookholder including an easel which is both retractable and adjustable for readily supporting bound or unbound (looseleaf) materials at a convenient angle for reading, studying, copying, and the like.

BACKGROUND ART

Effective study requires reading a large amount of textbook or reference materials in either bound or looseleaf form. Proper support of such materials minimizes fatigue and eyestrain and thus facilitates reading and retention of the information therein. Placing the materials on a flat desk or table top may not be the best for effective studying because the reader or student often has to lean over the materials for the best view, which itself leads to fatigue. It is usually best to prop the reading material at some angle roughly perpendicular to the reader or student's line of sight to reduce glare from overhead lights and to minimize eyestrain and fatigue. However, the best angle of support depends upon the reader's height and posture, relationship to the chair and table top, available lighting, etc.

Various bookstands or bookholders have been developed for this purpose. For example, U.S. Pat. No. 2,451,694 to Schade shows a three-ring binder with an easel pivoted about the inside of the top edge of the spine. U.S. Pat. No. 1,278,619 to Fant shows a bookholder with a U-shaped brace which is pivoted to the back and secured by a flexible chain. U.S. Pat. No. 4,355,821 to Crawford illustrates a display binder in which the lower portions of the covers can be flexed and secured to act like an easel. U.S Pat. No. 2,490,356 to Hummel shows a collapsible bookrest. Nevertheless, these prior approaches have tended to be relatively complex and/or expensive, and have not been readily adjustable for best use by the particular reader or student.

A need has thus developed for an improved bookholder of inexpensive construction having a collapsible easel that is readily adjustable to suit the user.

SUMMARY OF THE INVENTION

The present invention comprises an improved bookstand or easel which overcomes the foregoing and other difficulties associated with the prior art. In accordance with the invention, there is provided a bookholder including interconnected covers and spine. Support members of generally inverted F-shaped cross section are secured to the lower edges of the covers for supporting bound or unbound materials when the bookholder is opened. A retractable easel is pivoted to the spine for movement between extended and retracted positions. The easel includes a rigid upper brace portion and a flexible but inextensible lower portion adapted for releasable attachment to a connector on the lower edge of the spine. Another connector is preferably provided for securing the folded easel portions together in the retracted position. In the preferred embodiment, the lower easel portion and connector comprise sections of hook-and-loop type material like that sold under the mark VELCRO, for positively retaining the easel in either retracted position or in adjustable, extended position.

BRIEF DESCRIPTION OF THE DRAWINGS

A better understanding of the invention can be had by reference to the following Detailed Description in conjunction with the accompanying Drawings, wherein:

FIG. 1 is a perspective view of the bookstand or bookholder of the present invention showing the easel in extended position;

FIG. 2 is a perspective view showing the easel in partially retracted position;

FIG. 3 is a perspective view of the bookholder in closed position; and

FIG. 4 is an enlarged sectional view taken along lines 4—4 of FIG. 2 in the direction of the arrows.

DETAILED DESCRIPTION

Referring now to the Drawing, wherein like reference numerals designate like or corresponding elements throughout the views, there is shown the adjustable bookstand or bookholder 10 of the invention. As will be explained more fully hereinafter, the bookholder 10 is of improved simplified construction incorporating an easel which is both retractable and adjustable.

The bookholder 10 includes opposite covers 12 and 14 connected to an intermediate spine 16. Spine rules 18 and 20 are provided between the spine 16 and covers 12 and 14, respectively, to define "living hinges" for pivotally interconnecting the covers and spine for movement between open and closed positions. The covers 12 and 14 and spine 16 can be of conventional vinyl-sealed construction similar to that utilized in the binder industry wherein sheets of cardboard or chipboard are sealed between sheets of vinyl, cut and heat-sealed about their peripheries to enclose the rigid inserts therein. If desired, additional partial sheets 22 and 24, sealed about their side and lower edges, can be provided on the lower inside surfaces of covers 12 and 14, respectively, to define retainer pockets.

Flange members 26 and 28 are secured to the lowermost edges of covers 12 and 14, respectively. The flange members 26 and 28 are preferably of inverted F-shaped cross section as best seen in FIG. 4, including a pair of upright parallel spaced apart portions connected to a projecting lateral portion. The upright portions of members 26 and 28 define slots for receiving the lower edges of the covers 12 and 14, respectively, which are then secured to the flange members by means of rivets 30 or other suitable fasteners. The projecting lateral portions of flange members 26 and 28 define supporting surfaces for the bound or unbound material to be held when the bookholder 10 is open. The projecting lateral portions of the members 26 and 28 are preferably slightly offset to avoid interference when the bookholder 10 is closed as shown in FIG. 3.

The bookholder 10 further includes a retractable easel 32 mounted on the spine 16. The easel 32 is both foldable and retractable. In particular, the easel 32 includes an upper rigid portion 34 and a lower flexible, but inextensible portion 36. The upper easel portion 34 is preferably secured to the top inside surface of spine 16 by rivets 38. The upper easel portion 34 also includes a hinge 40 which may comprise a living hinge of the type similar to hinges 18 and 20, which enables pivotal movement of the easel 32 between extended and retracted positions. FIG. 1 shows the easel 32 in extended position, while FIG. 2 shows it in the near-retracted position. The upper easel portion 34, which serves as a brace or support, can be of vinyl-covered chipboard construction like covers 12 and 14 and spine 16, but is preferably constructed of plastic or vinyl-covered plastic for additional strength.

The lower easel portion 36 is preferably formed of flexible but substantially inextensible material, such as hook-and-loop type fastener material known as VELCRO. A corresponding releasable connector 42 of similar materal, as is best seen in FIG. 2, is provided on the lower inside surface of spine 16 for releasable connection to the lower easel portion 36 when the easel 32 is extended so as to provide adjustability. The lower easel portion 36 can be formed from a length of the "loop" portion, while the connector 42 can be formed from a section of the "hook" portion of such material. This comprises an important feature of the invention which allows ready and convenient adjustability of the angle of inclination of the bookholder 10 to best suit the user. The lower easel portion 36 can be connected to connector 42 along the length of the lower easel portion, to adjust the angle of bookholder 10 as desired.

In accordance with the preferred construction, connectors 44 and 46 are also provided on opposite sides of the upper easel portion 34 at opposite ends thereof to positively retain the easel 32 in retracted position inside the bookholder 10. The connector 44 engages connector 40, while the connector 46 engages the free end of the lower easel portion 36, where the easel 32 is retracted and retained. Connector 46 is preferably of similar construction to connector 42. Connector 44 can comprise a separate connector, but preferably comprises an end of the lower easel portion 36 folded about and glued or otherwise fastened to the lower end of the upper easel portion 34. Although this type of connector is preferred, it will be understood that other types of suitable fasteners or connectors could be utilized.

From the foregoing, it will thus be apparent that the present invention comprises an improved adjustable bookstand or bookholder having several advantages over the prior art. One advantage is that the bookholder herein is of sturdy but inexpensive construction. Another advantage is that the easel, which is normally retained in retracted position, can be extended and then be readily and conveniently adjusted to support the bookholder at the desired angle of inclination depending upon the user. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

I claim:

1. An adjustable bookholder, which comprises:

a pair of covers secured to opposite edges of an intermediate spine for relative pivotal movement between opened and closed positions;

said spine and covers each having inside and outside surfaces and upper and lower edges;

ledge means secured to the lower edges of said covers for supporting bound or unbound materials thereon;

a rigid first member pivotally secured at one end to the upper edge of said spine for pivotal movement between extended and retracted positions;

a flexible but substantially inextensible second member secured at one end to the other end of said first member;

a releasable first connector secured to the lower inside surface of said spine for releasable engagement with said cross member for adjusting the desired angle of inclination of the bookholder; and releasable second and third connectors secured to opposite ends of said first member for releasable engagement with the said other ends of said first and second members, respectively to retain said members in retracted position.

2. The bookholder of claim 1, wherein said ledge means comprises members of generally inverted F-shaped cross section.

3. The bookholder of claim 1, further including:

means defining a retainer pocket on the inner surface of each cover.

* * * * *